US011242776B2

(12) United States Patent
Iwaya et al.

(10) Patent No.: US 11,242,776 B2
(45) Date of Patent: Feb. 8, 2022

(54) VALVE OPEN-CLOSE TIMING CONTROL DEVICE

(71) Applicant: AISIN SEIKI KABUSHIKI KAISHA, Kariya (JP)

(72) Inventors: Takashi Iwaya, Kariya (JP); Masahiro Okado, Kariya (JP); Toi Suzuki, Kariya (JP); Toshiki Miyake, Kariya (JP); Takano Nakai, Hiroshima-ken (JP); Kenichiro Suzuki, Hiroshima-ken (JP); Yoshiyuki Kamoyama, Hiroshima-ken (JP); Toru Hirota, Hiroshima-ken (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 17/205,588

(22) Filed: Mar. 18, 2021

(65) Prior Publication Data

US 2022/0003133 A1 Jan. 6, 2022

(30) Foreign Application Priority Data

Jul. 1, 2020 (JP) ..... JP2020-114253

(51) Int. Cl.

*F01L 1/352* (2006.01)
*F01L 1/047* (2006.01)
*F01L 13/00* (2006.01)

(52) U.S. Cl.

CPC ..... *F01L 1/352* (2013.01); *F01L 1/047* (2013.01); *F01L 2013/103* (2013.01);
(Continued)

(58) Field of Classification Search

CPC ... F01L 1/047; F01L 1/352; F01L 1/46; F01L 2013/103; F01L 2013/111;
(Continued)

(56) References Cited

U.S. PATENT DOCUMENTS

2001/0042528 A1* 11/2001 Takahashi ..... F01L 1/3442 123/90.15
2005/0211207 A1 9/2005 Urushibata et al.
(Continued)

FOREIGN PATENT DOCUMENTS

JP 2004162706 A 6/2004
JP 2017008729 A 1/2017
(Continued)

*Primary Examiner* — Jorge L Leon, Jr.
(74) *Attorney, Agent, or Firm* — Buchanan Ingersoll & Rooney PC

(57) ABSTRACT

A valve open-close timing control device includes a driving rotator, a driven rotator, a phase adjusting mechanism, a sensor unit, a storage configured to store the plurality of divided regions consecutively provided, as a plurality of divided length information pieces corresponding to divided lengths of the divided regions, and an actual phase acquisition unit configured to start acquisition of the crank angle signal and the cam angle signal along with start of actuation control of actuating the internal combustion engine, specify one of the divided regions by referring to the divided length information pieces stored in the storage in accordance with the crank angle signal at timing set in accordance with the cam angle signal, and acquire the relative rotation phase as an actual phase in accordance with the crank angle signal corresponding to the boundary of the divided region thus specified and the reference crank angle signal.

4 Claims, 9 Drawing Sheets

(52) U.S. Cl.
CPC .... *F01L 2013/111* (2013.01); *F01L 2013/113* (2013.01); *F01L 2201/00* (2013.01); *F01L 2800/14* (2013.01); *F01L 2820/041* (2013.01); *F01L 2820/042* (2013.01)

(58) Field of Classification Search
CPC ..... F01L 2013/113; F01L 2201/00; F01L 2800/14; F01L 2820/032; F01L 2820/041; F01L 2820/042
USPC ..... 123/90.15, 90.17
See application file for complete search history.

(56) References Cited

U.S. PATENT DOCUMENTS

| | | | | |
|---|---|---|---|---|
| 2006/0207534 | A1* | 9/2006 | Machida | F01L 1/344 123/90.16 |
| 2006/0260573 | A1 | 11/2006 | Urushibata et al. | |
| 2012/0303251 | A1* | 11/2012 | Shimizu | F02D 13/0238 701/113 |
| 2015/0211424 | A1* | 7/2015 | Nomura | F01L 1/352 123/472 |
| 2018/0051645 | A1 | 2/2018 | Mikawa | |
| 2018/0340465 | A1* | 11/2018 | Mikawa | F02B 33/18 |
| 2019/0178114 | A1* | 6/2019 | Iwaya | F01L 1/3442 |
| 2020/0011252 | A1 | 1/2020 | Sato et al. | |

FOREIGN PATENT DOCUMENTS

| | | | |
|---|---|---|---|
| JP | 2018194003 | A | 12/2018 |
| JP | 2020007942 | A | 1/2020 |

* cited by examiner

VALVE OPEN-CLOSE TIMING CONTROL DEVICE

CROSS REFERENCE TO RELATED APPLICATIONS

This application is based on and claims priority under 35 U.S.C. § 119 to Japanese Patent Application No. 2020-114253, filed on Jul. 1, 2020, the entire content of which is incorporated herein by reference.

TECHNICAL FIELD

This disclosure relates to a valve open-close timing control device.

BACKGROUND DISCUSSION

JP 2017-8729 A and JP 2020-7942 A each describe a valve open-close timing control device including a driving rotator configured to rotate in synchronization with a crank shaft, a driven rotator configured to rotate integrally with a cam shaft, and sensors configured to individually detect rotation of the driving rotator and the driven rotator, the valve open-close timing control device configured to calculate a relative rotation phase between the driving rotator and the driven rotator in accordance with detection results of the sensors.

JP 2017-8729 A describes the valve open-close timing control device including a crank angle sensor configured to detect a crank angle signal having a plurality of reference positions as references along with rotation of the crank shaft, and a cam angle sensor configured to detect a plurality of cam signal pulses in accordance with rotation of an inlet cam shaft, as well as a processing mode of calculating an actual relative rotation phase in accordance with a cam angle signal initially detected upon actuation of an internal combustion engine and a signal for an initial reference position from the crank angle sensor.

The cam angle sensor according to JP 2017-8729 A includes a signal plate having an outer circumference divided into four regions respectively provided with one, three, four, and two projections, and a rotation detection device configured to detect the projections. The cam angle sensor detects a different number of pulse signals in each of the four regions when the cam shaft rotates.

JP 2020-7942 A describes the valve open-close timing control device including the driving rotator, the driven rotator, an electric motor configured to control a relative rotation phase between the driving rotator and the driven rotator, and a phase sensing unit configured to acquire the relative rotation phase and including a crank angle sensor configured to detect a pulse signal along with rotation of the crank shaft, and a cam angle sensor configured to detect four sensing signals while the cam shaft rotates once, as well as a processing mode of calculating a relative rotation phase between the driving rotator and the driven rotator in accordance with detection signals of these sensors.

The cam angle sensor according to JP 2020-7942 A includes a rotator provided at an inlet cam shaft and having four sensing regions with different circumferential lengths, and a cam sensor configured to sense these sensing regions. While the inlet cam shaft rotates once, the cam sensor detects circumferentially rear ends of the four sensing regions to output sensing signals at different timings.

When an internal combustion engine is actuated, desired in terms of stable actuation of the internal combustion engine is acquisition of a relative rotation phase of a valve open-close timing control device as soon as possible after cranking start and a shift to a relative rotation phase appropriate for actuation.

JP 2017-8729 A sets the processing mode of calculating the relative rotation phase by detecting a signal of the cam angle sensor after cranking start and causing the crank angle sensor to detect the initial reference position. However, calculation of the relative rotation phase requires accurate counting of the pulse signals detected by the cam angle sensor.

The rotation detection device may be positioned between any two of the regions provided with the one, three, four, and two projections when the internal combustion engine is actuated. In such a case, the cam angle sensor detects an inappropriate number of pulse signals and an initial count value is actually inapplicable to calculation. Accordingly, there needs more time for further rotation of the cam shaft in order to accurately count the number of the projections.

According to JP 2017-8729 A, the relative rotation phase is determined when the crank angle sensor detects the reference position after the cam angle sensor accurately counts the pulse signals. The crank shaft thus rotates until acquisition of the relative rotation phase, and it needs time to start control of the valve open-close timing control device.

It will need time because the cam sensor according to JP 2020-7942 A needs to sense at least two of the four ends of the sensing regions of the rotator in order for calculation of the relative rotation phase.

A need thus exists for a valve open-close timing control device which is not susceptible to the drawback mentioned above.

SUMMARY

This disclosure provides a valve open-close timing control device including: a driving rotator rotatable about a rotation axis and configured to rotate simultaneously with a crank shaft of an internal combustion engine; a driven rotator rotatable about the rotation axis and configured to rotate integrally with a cam shaft for valve opening-closing in the internal combustion engine; a phase adjusting mechanism configured to set a relative rotation phase between the driving rotator and the driven rotator with use of drive power of an electric motor; a sensor unit configured to detect the relative rotation phase, the sensor unit including a crank angle sensor configured to detect a crank angle signal as angle information along with rotation of the crank shaft, and a reference crank angle signal as angle information from a reference position preliminarily set, along with rotation of the crank shaft, and a cam angle sensor configured to detect a cam angle signal each time the cam angle sensor reaches a boundary of each of divided regions obtained by preliminarily dividing a single-rotation region of the cam shaft at unequal angles; a storage configured to store the plurality of divided regions consecutively provided, as a plurality of divided length information pieces corresponding to divided lengths of the divided regions; and an actual phase acquisition unit configured to start acquisition of the crank angle signal and the cam angle signal along with start of actuation control of actuating the internal combustion engine, specify one of the divided regions by referring to the divided length information pieces stored in the storage in accordance with the crank angle signal at timing set in accordance with the cam angle signal, and acquire the relative rotation phase as an actual phase in accordance with the crank angle signal corresponding to the boundary of the divided region thus specified and the reference crank angle signal.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of this disclosure will be described hereinafter with reference to the drawings.

Figure 1:
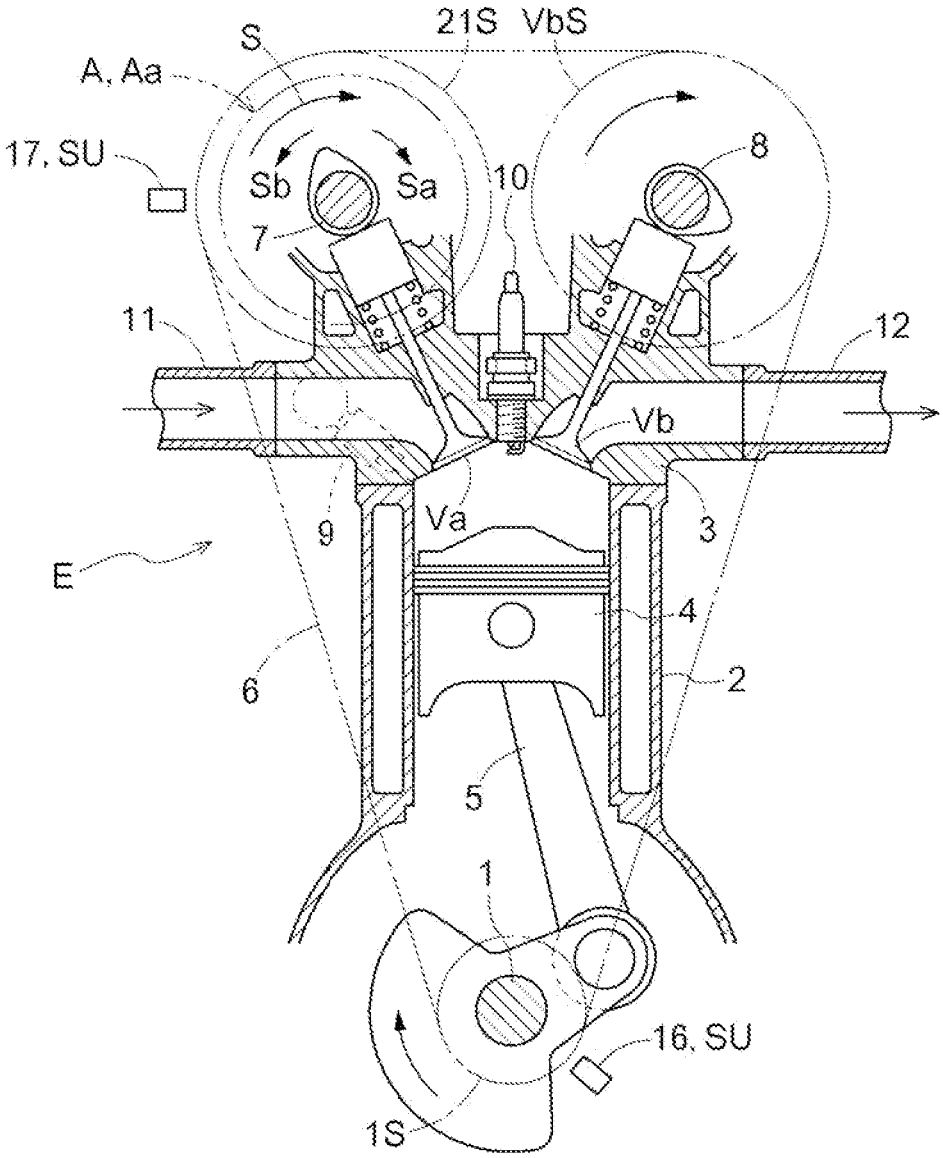
FIG. 1 is a sectional view of an engine.

Basic configuration FIG. 1 depicts an engine E functioning as an internal combustion engine and including an intake valve Va, an exhaust valve Vb, and a valve open-close timing control device A configured to set valve timing (open-close timing) of the intake valve Va. The engine E (internal combustion engine) depicted in FIG. 1 is equipped in a vehicle such as a passenger car.

Figure 2:
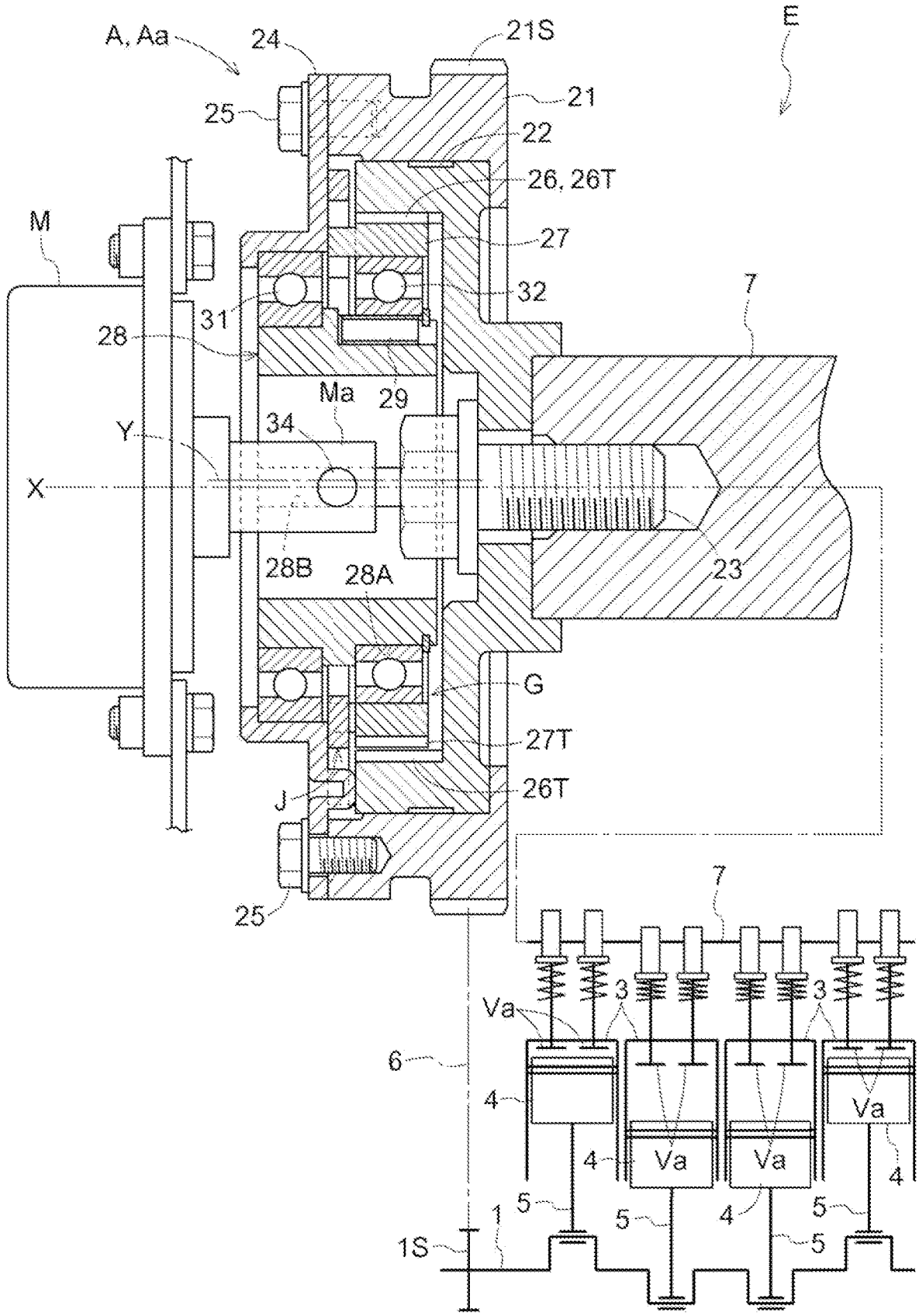
FIG. 2 is a sectional view of a valve open-close timing control mechanism.
Figure 3:
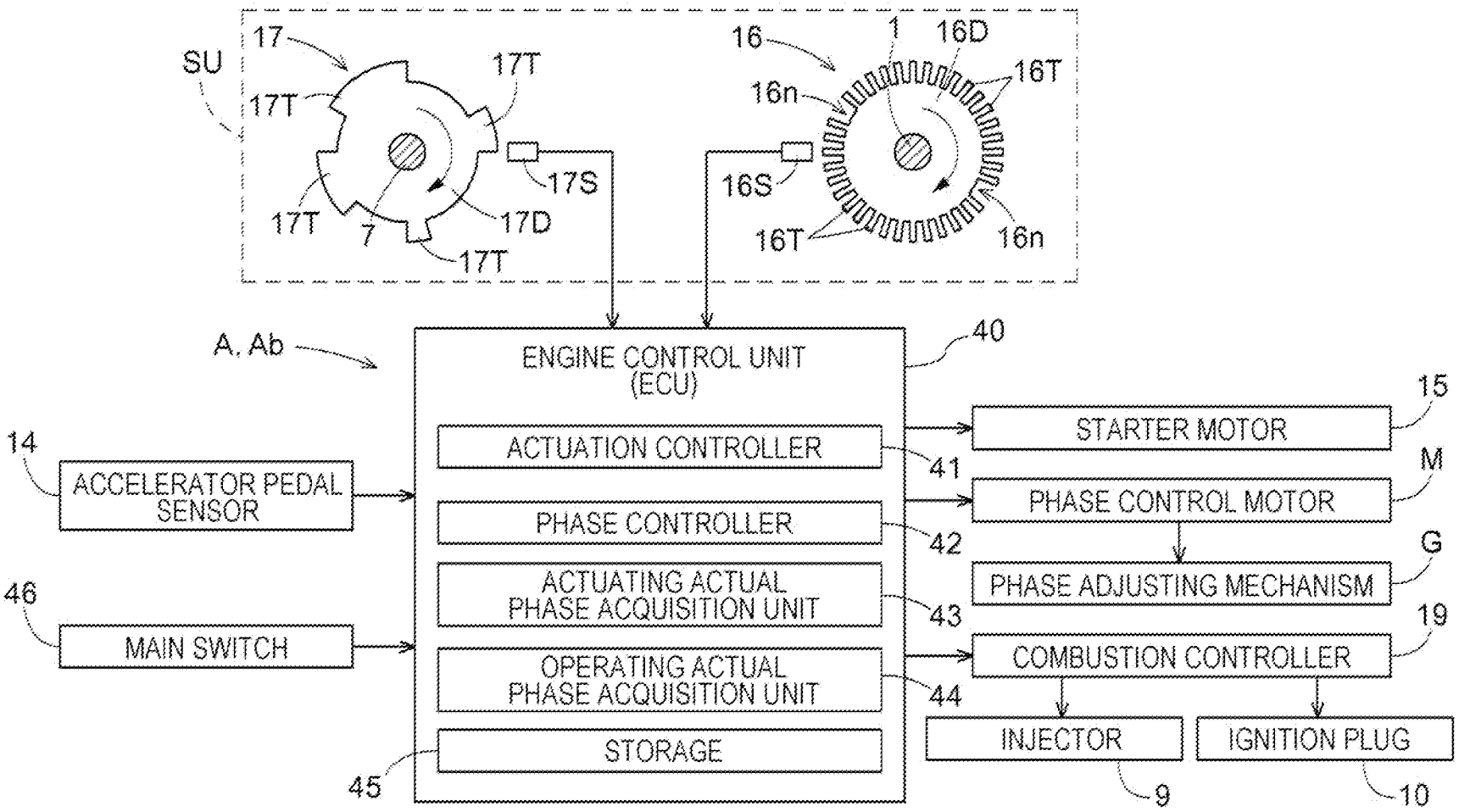
FIG. 3 is a block diagram of an engine control unit.

The engine E is controlled by an engine control device 40 depicted in FIG. 3. As depicted in FIGS. 2 and 3, the valve open-close timing control device A includes an operation body Aa constituted by hardware configured to determine valve timing of the intake valve Va with use of drive power of a phase control motor M (exemplifying the electric motor), and a control unit Ab including software of the engine control device 40 for control of the phase control motor M.

As depicted in FIG. 2, the operation body Aa in the valve open-close timing control device A includes a driving case 21 (exemplifying the driving rotator), an internal rotor 22 (exemplifying the driven rotator), and a phase adjusting mechanism G configured to change a relative rotation phase between the driving case 21 and the internal rotor 22 (hereinafter, simply mentioned the "relative rotation phase" in some cases) with use of drive power of the phase control motor M (exemplifying the electric motor). Meanwhile, the control unit Ab includes the software configured to control valve timing of the intake valve Va by controlling the phase control motor M in accordance with a signal of a crank angle sensor 16, a cam angle sensor 17, or the like included in the engine control device 40.

The relative rotation phase between the driving case 21 and the internal rotor 22 corresponds to a relative angle between the driving case 21 and the internal rotor 22 around a rotation axis X of an inlet cam shaft 7. The relative rotation phase is changed to change valve timing of the intake valve Va.

As depicted in FIG. 1, the engine E includes a crank shaft 1, a cylinder block 2 supporting the crank shaft 1, a cylinder head 3 disposed above and coupled to the cylinder block 2, a piston 4 reciprocatably accommodated in a plurality of cylinder bores provided in the cylinder block 2, and a connecting rod 5 coupling the piston 4 to the crank shaft 1, so as to constitute a four cycle type engine.

The cylinder head 3 includes the intake valve Va and the exhaust valve Vb, and is provided thereabove with the inlet cam shaft 7 (exemplifying a cam shaft for valve opening-closing) configured to control the intake valve Va and an exhaust cam shaft 8 configured to control the exhaust valve Vb. There is provided a timing belt 6 wound to surround an output pulley 1S of the crank shaft 1, a driving pulley 21S of the operation body Aa in the valve open-close timing control device A, and an exhaust pulley VbS of the exhaust valve Vb.

The cylinder head 3 includes an injector 9 configured to inject fuel into a combustion chamber and an ignition plug 10. The cylinder head 3 is coupled with an intake manifold 11 configured to supply the combustion chamber with air via the intake valve Va, and an exhaust manifold 12 configured to send out combustion gas from the combustion chamber via the exhaust valve Vb.

As depicted in FIGS. 1 to 3, the engine E includes a starter motor 15 configured to drive to rotate the crank shaft 1, the crank angle sensor 16 disposed adjacent to the crank shaft 1 and configured to detect a rotation angle, and the cam angle sensor 17 disposed adjacent to the inlet cam shaft 7 and configured to detect a rotation angle of the inlet cam shaft 7. The crank angle sensor 16 and the cam angle sensor 17 are collectively called a sensor unit SU.

The engine control device 40 is configured as an engine control unit (ECU) configured to control the engine E, and includes a actuation controller 41, a phase controller 42, a actuating actual phase acquisition unit 43 (exemplifying the actual phase acquisition unit), an operating actual phase acquisition unit 44, and a storage 45.

Valve Open-Close Timing Control Device: Operation Body

As depicted in FIG. 2, the operation body Aa includes the driving case 21 (driving rotator) and the internal rotor 22 (driven rotator) disposed coaxially with the rotation axis X of the inlet cam shaft 7, and the phase adjusting mechanism G configured to set a relative rotation phase between the driving case 21 and the internal rotor 22 with use of drive power of the phase control motor M.

The driving case 21 has an outer circumference provided with the driving pulley 21S. The internal rotor 22 is provided inside the driving case 21 and is fixedly coupled to the inlet cam shaft 7 by means of a coupling bolt 23. In this configuration, the driving case 21 is relatively rotatably supported on an outer circumference of the internal rotor 22 fixedly coupled to the inlet cam shaft 7.

The driving case 21 and the internal rotor 22 interpose the phase adjusting mechanism G, and a plurality of fastening bolts 25 fastens a front plate 24 positioned to cover an opening of the driving case 21. The front plate 24 restrains displacement of the phase adjusting mechanism G and the internal rotor 22 along the rotation axis X.

As depicted in FIG. 1, the operation body Aa is entirely rotated in a drive rotation direction S by drive power from the timing belt 6. Drive power of the phase control motor M is decelerated by the phase adjusting mechanism G and is transmitted to the internal rotor 22 to enable displacement of the relative rotation phase of the internal rotor 22 to the driving case 21. The displacement may be made in an advance direction Sa as a displacement direction along the drive rotation direction S, or in a retard direction Sb as an opposite direction.

Valve Open-Close Timing Control Device: Phase Adjusting Mechanism

As depicted in FIG. 2, the phase adjusting mechanism G includes a ring gear 26 provided on an inner circumference of the internal rotor 22 and disposed coaxially with the rotation axis X, an inner gear 27 disposed adjacent to the inner circumference of the internal rotor 22 so as to be rotatable coaxially with an eccentric axis Y from the rotation axis X, an eccentric cam body 28 disposed adjacent to an inner circumference of the inner gear 27, the front plate 24, and a joint J. The eccentric axis Y and the rotation axis X are parallel to each other.

The ring gear 26 has a plurality of internal teeth 26T, the inner gear 27 has a plurality of external teeth 27T, and some of the external teeth 27T mesh with the internal teeth 26T of the ring gear 26. The phase adjusting mechanism G is configured as an internal planetary gear reducer including the external teeth 27T of the inner gear 27 smaller in the number by one than the internal teeth 26T of the ring gear 26.

The joint J is configured as an Oldham coupling that keeps positional relation of the inner gear 27 eccentric to the driving case 21 as well as integrally rotates the inner gear 27 and the driving case 21.

The eccentric cam body 28 entirely has a tubular shape, and has an inner circumference provided with a pair of engagement grooves 28B extending parallelly to the rotation axis X. The eccentric cam body 28 is supported to the front plate 24 by means of a first bearing 31 so as to rotate coaxially with the rotation axis X, and has an eccentric cam surface 28A provided on an outer circumference of a portion adjacent to the inlet cam shaft 7 from a position thus supported.

The eccentric cam surface 28A has a circular shape (a circular sectional shape) around the eccentric axis Y parallel to the rotation axis X. The inner gear 27 is rotatably supported to the eccentric cam surface 28A via a second bearing 32. The eccentric cam surface 28A has a recess in which a spring 29 is fitted, and the spring 29 has bias force applied to the inner gear 27 via the second bearing 32. In this configuration, some of the external teeth 27T of the inner gear 27 mesh with some of the internal teeth 26T of the ring gear 26, and the bias force of the spring 29 keeps such a meshed state.

The phase control motor M is supported at the engine E, and has an output shaft Ma provided with an engagement pin 34 fitted in the engagement grooves 28B provided in the inner circumference of the eccentric cam body 28. Though not depicted in detail, the phase control motor M includes a rotor having a permanent magnet, and a stator having a plurality of field coils positioned to surround the rotor, to structure a brushless motor in common with a three-phase motor.

The valve open-close timing control device A drives to rotate the output shaft Ma in the drive rotation direction S at speed equal to speed of the crank shaft 1 while the engine E is in operation, to keep a relative rotation phase of the valve open-close timing control device A. The output shaft Ma has rotational speed that is controlled to reduce for displacement of the relative rotation phase in the advance direction Sa or to increase for displacement of the relative rotation phase in the retard direction Sb.

While the engine E stops, the eccentric cam body 28 in the phase adjusting mechanism G rotates about the rotation axis X along with rotation of the output shaft Ma by drive of the phase control motor M, and the inner gear 27 and the ring gear 26 are relatively rotated by an angle corresponding to the difference in the numbers of the teeth each time the inner gear 27 rotates once. This relatively rotates the driving case 21 rotating integrally with the inner gear 27 via the joint J and the inlet cam shaft 7 coupled to the ring gear 26 by means of the coupling bolt 23, to achieve adjustment of valve timing.

Control Configuration

As depicted in FIG. 3, the engine control device 40 receives detection signals from the crank angle sensor 16 and the cam angle sensor 17, as well as receives signals from a main switch 46 and an accelerator pedal sensor 14. The engine control device 40 transmits a control signal to each of the starter motor 15, the phase control motor M, and a combustion controller 19.

The engine control device 40 actuates the engine E when the main switch 46 is turned ON, and stops the engine E when the main switch 46 is turned OFF. If the engine control device 40 detects, in accordance with the signal from the accelerator pedal sensor 14, that an accelerator pedal (not depicted) is pressed down for change in manipulated variable while the engine E is in operation, the combustion controller 19 controls a fuel injection amount of the injector 9 and ignition timing of the ignition plug 10.

Hereinafter, the relative rotation phase between the driving case 21 and the internal rotor 22 has a real phase to be called an actual phase, and a phase targeted during control to be called a target phase.

In order to actuate the engine E being stopped, the actuation controller 41 causes the starter motor 15 to start cranking when the main switch 46 is turned ON, and causes the actuating actual phase acquisition unit 43 to early acquire an actual phase of the operation body Aa. The actuation controller 41 further sets a target phase of the operation body Aa in the valve open-close timing control device A to a phase appropriate for actuation, executes feedback control of feedbacking the actual phase acquired by the actuating actual phase acquisition unit 43 to shift open-close timing of the intake valve Va to a phase most appropriate for actuation, and controls the combustion controller 19 to cause the injector 9 to inject fuel and cause the ignition plug 10 to ignite, so as to actuate the engine E.

The phase controller 42 sets a target phase for operation of the engine E. The actuating actual phase acquisition unit 43 has a processing mode set so as to early acquire the actual phase (relative rotation phase) of the valve open-close timing control device A when the engine E is actuated as described above. The operating actual phase acquisition unit 44 acquires the actual phase while the engine E is in operation. The storage 45 is constituted by a nonvolatile memory such as an EEPROM, and stores information on divided lengths (hereinafter, called divided length information) of a plurality of divided regions depicted in FIG. 4. The divided regions and the divided lengths will be described later.

Control Configuration: Crank Angle Sensor

As depicted in FIG. 3, the crank angle sensor 16 includes a gear shape member 16D configured to rotate integrally with the crank shaft 1, made of a magnetic material, and having an outer circumference provided with a plurality of detection target teeth 16T, and a pickup crank sensor 16S (exemplifying the detection mechanism) supported at the engine E (specifically exemplifying the fixed system) to detect the detection target teeth 16T while the crank shaft 1 is rotating. The crank angle sensor 16 has two reference positions 16*n* distant from each other by 180 degrees and serving as a non-tooth part obtained by removing one of the plurality of detection target teeth 16T.

The crank angle sensor 16 rotates in a direction indicated by an arrow in FIG. 3 and detects a crank angle signal as angle information along with rotation of the crank shaft 1, so as to detect a reference crank angle signal as angle information, from one of the reference positions 16*n* preliminarily set, along with rotation of the crank shaft.

Figure 5:
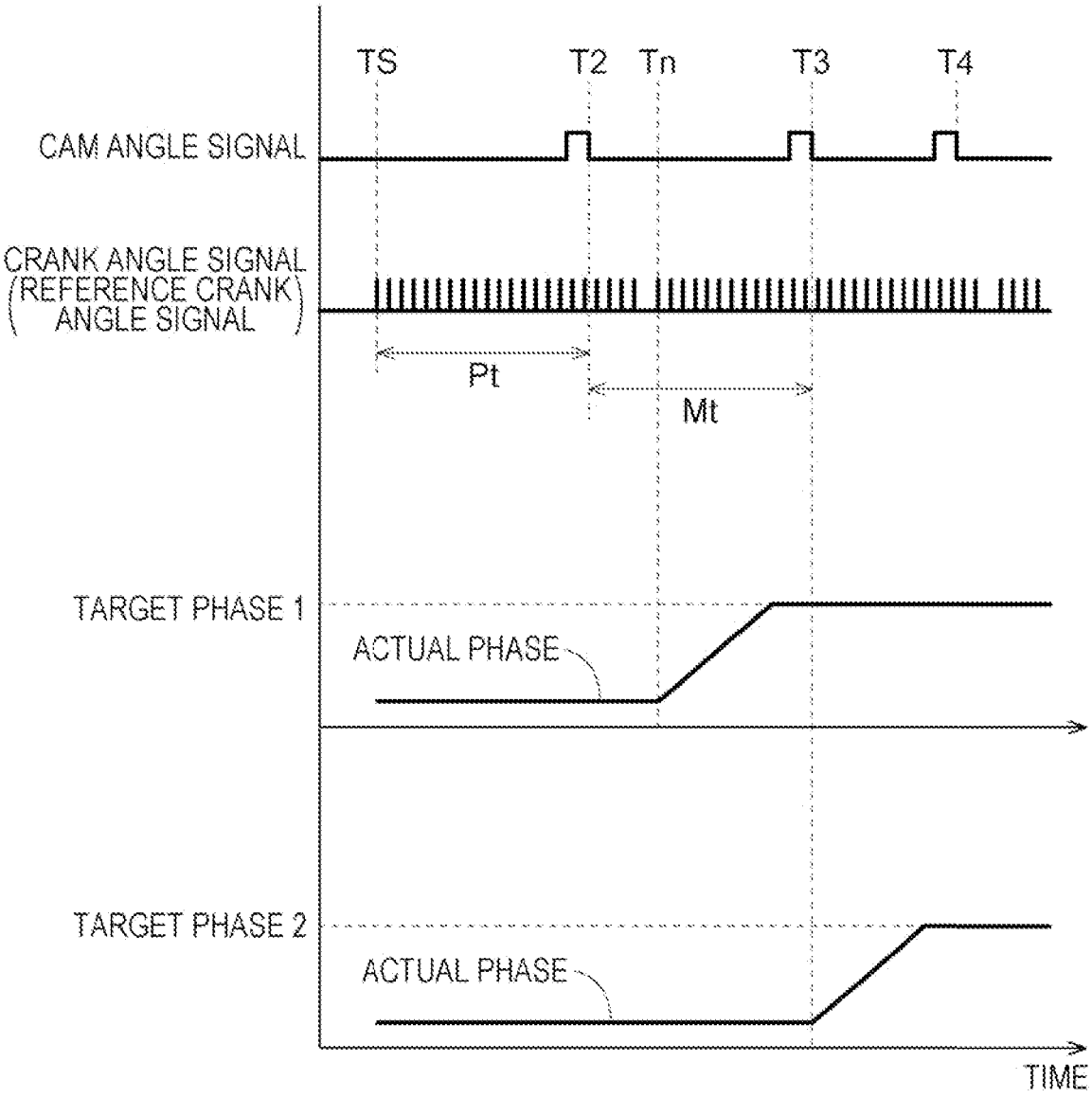
FIG. 5 is a timing chart for control of the valve open-close timing control mechanism.

The crank angle signal is angle information along with rotation of the crank shaft 1, and is detected each time the detection target teeth 16T approach the crank sensor 16S, as a pulse signal indicated in FIG. 5. Accordingly, counting such pulse signals from appropriate timing enables detection of a crank angle with reference to the appropriate timing. The reference crank angle signal corresponds to a count value with reference to the reference position 16*n*, and enables detection of a rotation angle of the crank shaft 1 with reference to the reference position 16*n*. The processing mode is set to obtain an accurate count value with processing of interpolating a signal in place of a lacked pulse signal due to absence of one tooth (processing of adding one count) at the reference position 16*n* particularly when the pulse signals are counted as the crank angle signals.

Control Configuration: Cam Angle Sensor

Figure 4:
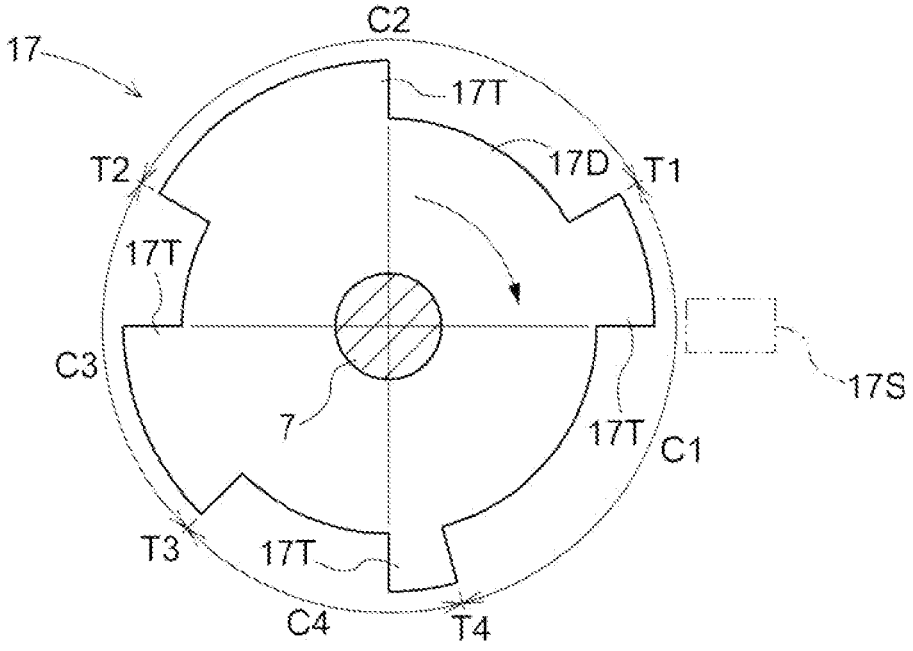
FIG. 4 is a view of a cam angle sensor.

As depicted in FIGS. 3 and 4, the cam angle sensor 17 includes a rotary member 17D configured to rotate integrally with the inlet cam shaft 7, made of a magnetic material, and having an outer circumference provided with four detection target projections 17T, and a pickup cam sensor 17S (exemplifying the detector) supported at the engine E (specifically exemplifying the fixed system) to detect the detection target projections 17T.

The rotary member 17D rotates in a direction indicated by an arrow in each of FIGS. 3 and 4, and sets positions of rotation downstream ends (front ends in a rotation direction) of the four detection target projections 17T to positions obtained by dividing, into four equal parts, an entire circumference of a single-rotation region of the inlet cam shaft 7. The four detection target projections 17T have different circumferential lengths, to have rotation upstream ends (rear ends in the rotation direction) positioned to divide the entire circumference of the single-rotation region of the inlet cam shaft 7 into different circumferential lengths.

The rotary member 17D has a first divided region C1, a second divided region C2, a third divided region C3, and a fourth divided region C4 divided into four correspondingly to the four detection target projections 17T on the entire circumference of the single-rotation region of the inlet cam shaft 7. Timings of detection, by the cam sensor 17S, of the four rotation upstream ends (occasionally, called boundary positions or simply called edges) of the detection target projections 17T while the inlet cam shaft 7 rotates once are distinctively referred to as first timing T1, second timing T2, third timing T3, and fourth timing T4, and four signals detected by the cam sensor 17S at these timings are referred to as cam angle signals.

As depicted in FIG. 4, the rotary member 17D has relation on divided length information (information on divided lengths) set to satisfy the second divided region C2>the first divided region C1>the third divided region C3>the fourth divided region C4. The relative rotation phase is obtained through calculation in accordance with the timings of detection of the positions of the edges of the four divided regions (detection of the cam angle signals) and the reference crank angle signal. Each value of the divided length information is indicated by a count value of the crank angle signals detected as pulse signals by the crank angle sensor 16.

The four detection target projections 17T are provided correspondingly to the number of four cylinders included in the engine E. When the engine E is actuated, the cylinders each have a stroke (e.g. a combustion stroke) determined in accordance with the cam angle signals detected by the cam angle sensor 17 and the reference crank angle signal detected by the crank angle sensor 16, and the actuation controller 41 sets ignition orders of the cylinders in accordance with the determination result.

The storage 45 stores, as the divided length information, the count value of pulse signals as the crank angle signals in each of the first divided region C1, the second divided region C2, the third divided region C3, and the fourth divided region C4, as depicted in FIG. 4. By referring to the storage 45 with the count value for rotation of the crank shaft 1 exemplarily from the first timing T1 to the second timing T2, it is possible to specify the second divided region C2 having the divided length information corresponding to the count value.

The count value from the first timing T1 to the second timing T2 corresponds to a difference between a count value at the first timing T1 possibly already acquired and a count value at the second timing T2.

The divided length information on the divided regions C1 to C4 has size relation unlimited to that depicted in FIG. 4, and the timings T1 to T4 have relation also unlimited to that depicted in FIG. 4.

Upon actuation of the engine E, the engine control device 40 causes the actuating actual phase acquisition unit 43 to early acquire the actual phase, to execute control to cause the actuation controller 41 to quickly control to shift the relative rotation phase to a phase appropriate for actuation of the engine E in accordance with the actual phase.

Control Configuration: Detection Mode

While the engine E is in operation, the engine control device 40 causes the cam angle sensor 17 to acquire two consecutive cam angle signals exemplarily at the second timing T2 and the third timing T3 in FIG. 5, acquires a count value of the crank angle signals between acquisition (at an interval) of the two cam angle signals, and refers to the divided length information in the storage 45 in accordance with the count value thus acquired, to specify the detection target projection 17T having the edge of the third timing T3 when the cam sensor 17S detects the cam angle signal at the end (boundary) of the second detection target projection 17T.

Any one of the four detection target projections 17T is specified while the engine E is in operation in this manner, and the actual phase of the valve open-close timing control device A is acquired through calculation in accordance with the detection timing of the end (edge) of the detection target projection 17T thus specified and the reference crank angle signal of the crank angle sensor 16. Such processing of acquiring the actual phase while the engine E is in operation corresponds to a basic processing mode for actual phase acquisition, which is executed by the operating actual phase acquisition unit 44.

Control Mode

Upon actuation of the engine E, the engine control device 40 causes the actuating actual phase acquisition unit 43 to early acquire the actual phase of the valve open-close timing control device A, and executes feedback control to enable control to set the actual phase to a phase appropriate for actuation of the engine E.

Control Mode: Actuating Actual Phase Acquisition Processing

Figure 6:
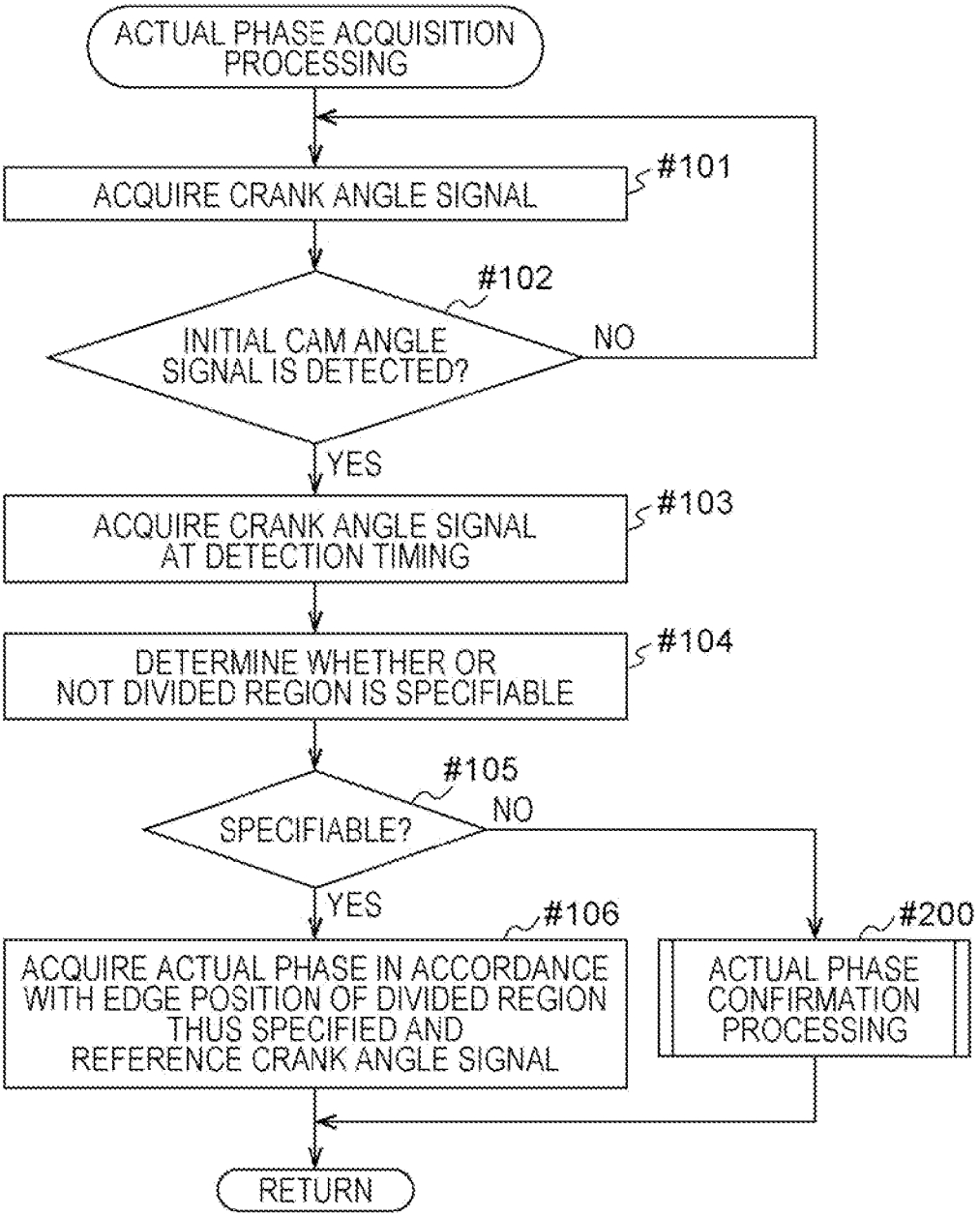
FIG. 6 is a flowchart of actual phase acquisition processing.

When the main switch 46 is turned ON to start driving the starter motor 15, the actuating actual phase acquisition unit 43 acquires (counts) the crank angle signals from the crank angle sensor 16 until the cam angle sensor 17 acquires the initial cam angle signal in accordance with cranking as depicted in actual phase acquisition processing in a flowchart of FIG. 6 (step #101 to step #103).

FIG. 5 is a timing chart of detection signals from start of actuation control. The count value of the crank angle signals at timing of acquisition of the initial cam angle signal by the cam angle sensor 17 corresponds to crank angle signals (count value) during an initial elapsed period Pt with reference to start timing TS. This chart specifically indicates the second timing T2 specifically exemplifying first detection timing for initial detection of the detection target projection 17T by the cam angle sensor 17.

The second timing T2 corresponds to the upstream edge (boundary position) in the rotation direction along the circumference of the second divided region C2. The second divided region C2 is longer in circumferential length than the remaining divided regions as described above. If the start timing TS is close to the first timing T1, the value of the crank angle signals detected during the initial elapsed period Pt (the count value of pulse signals detected by the crank angle sensor 16) may be larger than the count value corresponding to the divided length information on the first divided region C1.

For determination of such size relation, the storage 45 is referred to in accordance with the crank angle signals acquired in step #103 to determine whether or not the divided region can be specified (step #104 and step #105). If determined that the divided region can be specified (Yes in step #105), the actual phase is acquired in accordance with the crank angle signal (signal specifying the edge) at the second timing T2 and the reference crank angle signal (step #104 to step #106).

If the value of the crank angle signals acquired in step #103 is larger than the divided length information on the first divided region C1 stored in the storage 45, the crank angle signals acquired by the crank angle sensor 16 until the initial elapsed period Pt can be determined as signals corresponding to the second divided region C2. In step #105, timing of acquisition of the cam angle signal (timing of acquisition of the initial cam angle signal) in step #102 is determined as the second timing T2 at the upstream edge in the rotation direction of the second divided region C2. This determines the rotation angle of the inlet cam shaft 7 at the timing of acquisition of the initial cam angle signal, and the actual phase is acquired in accordance with the rotation angle of the inlet cam shaft 7 and the reference crank angle signal at the timing.

In this embodiment, the reference crank angle signal has a reference point Tn is positioned after the second timing T2 as indicated in FIG. 5. The actual phase is thus determined immediately after detection of the reference point Tn. Determination of the actual phase in this manner enables control to shift the relative rotation phase of the operation body Aa in the valve open-close timing control device A to the target phase (a target phase 1 in FIG. 5) immediately after reaching the reference point Tn as indicated in a middle part of the timing chart in FIG. 5.

Though not indicated, if the reference point Tn is positioned before the second timing T2, the reference point Tn is stored and the actual phase is acquired immediately after detection of the second timing T2. In this case, control to shift the relative rotation phase of the operation body Aa in the valve open-close timing control device A to the target phase is enabled earlier than the indication in the middle part of the timing chart in FIG. 5.

In a contrast case where a region corresponding to the value of the crank angle signals during the initial elapsed period Pt is shorter in circumferential length than the first divided region C1 and longer in circumferential length than the third divided region C3, it is impossible to determine, during the initial elapsed period Pt, whether the corresponding region is the first divided region C1 or the second divided region C2. If determined in step #105 that specification cannot be made (No in step #105), actual phase confirmation processing (step #200) is executed for reliable acquisition of the actual phase.

Figure 7:
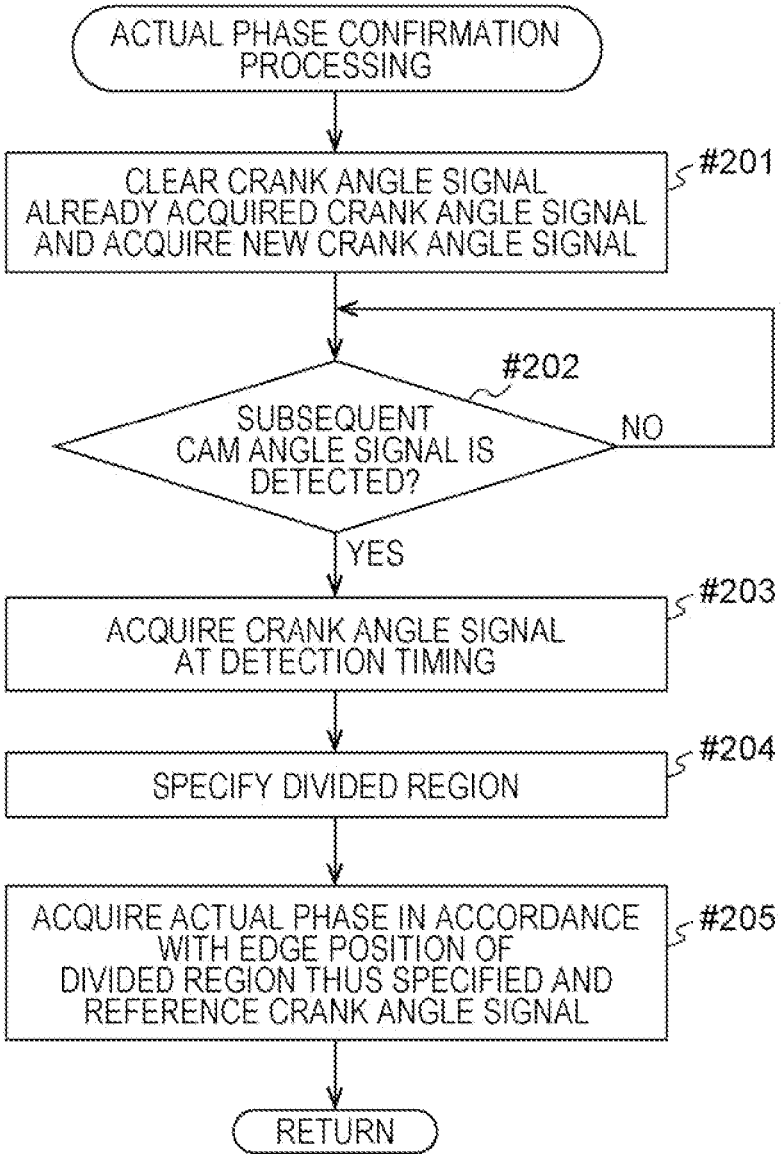
FIG. 7 is a flowchart of actual phase confirmation processing.

As depicted in FIG. 7, the actual phase confirmation processing (step #200) includes clearing already acquired crank angle signals as set as a sub routine (step #201), starting new acquisition of cam angle signals by the crank angle sensor 16, and acquiring the crank angle signals from the crank angle sensor 16 (step #201 to step #203) at timing of acquisition of a subsequent cam angle signal (Yes in step #202).

As indicated in FIG. 5, the crank angle signals thus acquired correspond to the crank angle signals (count value) during an intermediate elapsed period Mt after the initial elapsed period Pt including detection of the second timing T2 until detection of the third timing T3 (specifically exemplifying the second detection timing) by the cam sensor 17S. The storage 45 is then referred to in accordance with the crank angle signals acquired during the intermediate elapsed period Mt, the divided region is specified in accordance with the crank angle signals, and actual phase is acquired through calculation in accordance with the crank angle signal at the detection timing of the edge of the divided region thus specified and the reference crank angle signal (step #204 and step #205).

The actual phase confirmation processing (step #200) is executed for reliable confirmation of the actual phase in a case where the detection target projection 17T initially detected by the cam angle sensor 17 in the actual phase acquisition processing is not included in the second divided region C2 or is included in the second divided region C2 that cannot be specified by the value of the crank angle signals.

The storage 45 is thus referred to in accordance with the crank angle signals during the intermediate elapsed period Mt to reliably specify the corresponding divided region and acquire the actual phase in accordance with the crank angle signal corresponding to the edge of the divided region thus specified and the reference crank angle signal.

Determination of the actual phase in this manner enables control to shift the relative rotation phase of the operation body Aa in the valve open-close timing control device A to the target phase (a target phase 2 in FIG. 5) immediately after reaching the third timing T3 (as exemplary timing) as indicated in a bottom part of the timing chart in FIG. 5.

Operating Actual Phase Acquisition Processing

Though the operating actual phase acquisition unit 44 depicted in FIG. 3 has a processing mode not depicted in any drawing, the operating actual phase acquisition processing is executed by the operating actual phase acquisition unit 44 to acquire the actual phase for control of the relative rotation phase while the engine E is in operation, and is similar to the actual phase acquisition processing (step #200) in FIG. 7. This processing does not need early acquisition of the actual phase as described above, and includes acquiring two consecutive cam angle signals at the cam angle sensor 17 at the third timing T3 and the fourth timing T4 exemplarily indicated in FIG. 5, specifying the divided region by referring to the storage 45 in accordance with the cam angle signals between these timings (at an interval), and acquiring the actual phase through calculation of detection timing of the second cam angle signal and the reference crank angle signal detected by the crank angle sensor 16 (similarly to the processing of the flowchart in FIG. 7).

Noise Suppression Processing

The cam angle sensor 17 may erroneously detects noise as a cam angle signal. In order to eliminate such erroneous detection, a difference between the two consecutive cam angle signals may be obtained and the difference may be compared with the plurality of divided length information pieces stored in the storage 45 to determine that noise is included if the difference does not match any one of the divided length information pieces. Though such determination is effective, for improvement in determination accuracy, differences among three or more cam angle signals (two or more differences) are obtained and consecutive divided length information pieces are referred to in order to enable elimination of erroneous detection. Acquisition of the three or more cam angle signals are ideally achieved by acquiring four cam angle signals while the inlet cam shaft 7 rotates once (in one cycle).

Such a noise suppression routine is executed along with the actual phase acquisition processing, and enables processing in accordance with the appropriate cam angle signals including no noise even in a case where the cam angle signals include noise in the actual phase acquisition processing.

Figure 8:
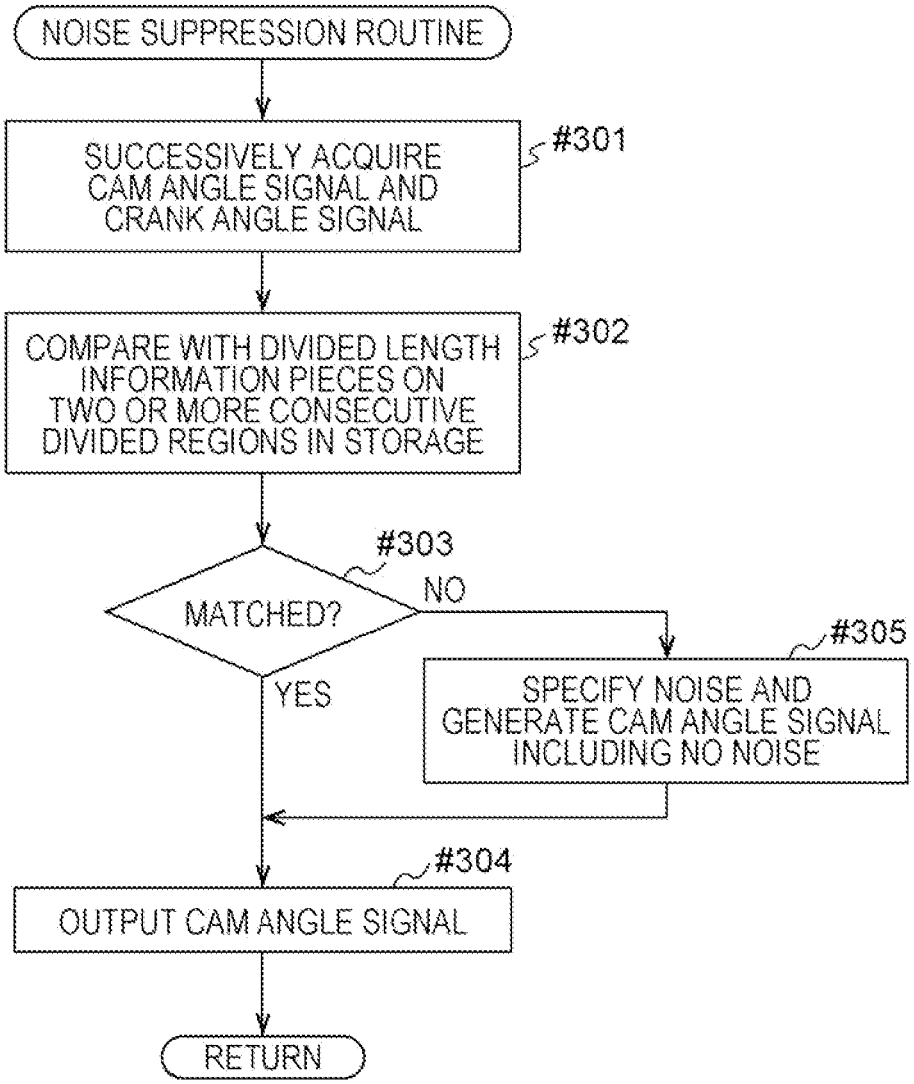
FIG. 8 is a flowchart of a noise suppression routine.

As depicted in a flowchart of FIG. 8, the cam angle signals and the crank angle signals are consecutively acquired, and the storage 45 is referred to in accordance with the crank angle signal corresponding to the difference (interval) between two or more consecutive cam angle signals among the cam angle signals thus acquired, to compare with two or more consecutive divided length information pieces on the divided regions stored in the storage 45 (step #301 and step #302).

The cam angle signals thus acquired are outputted if all the signals match the divided length information pieces. If any of the signals does not match any one of the divided length information pieces (No in step #302), the signal not matching any one of the divided length information pieces is specified as noise, and cam angle signals are generated and outputted, excluding the signal thus specified (step #303 to step #304).

Reference Position Determination Processing

As described above, detection of the reference crank angle signal by the crank angle sensor 16 needs appropriate determination of the non-tooth part at the reference position 16*n*. In a case where the crank shaft 1 has low rotational speed upon actuation of the engine E, pulse signals tend to have a longer interval in comparison to a case with high rotational speed to hardly achieve appropriate determination. Determination of the reference position 16*n* is thus executed in one of processing modes switched in accordance with rotational speed of the crank shaft 1.

The reference position determination processing is executed along with the actual phase acquisition processing, and accurate determination of the reference position enables accurate control with the reference crank angle signal kept at an appropriate value.

Figure 9:
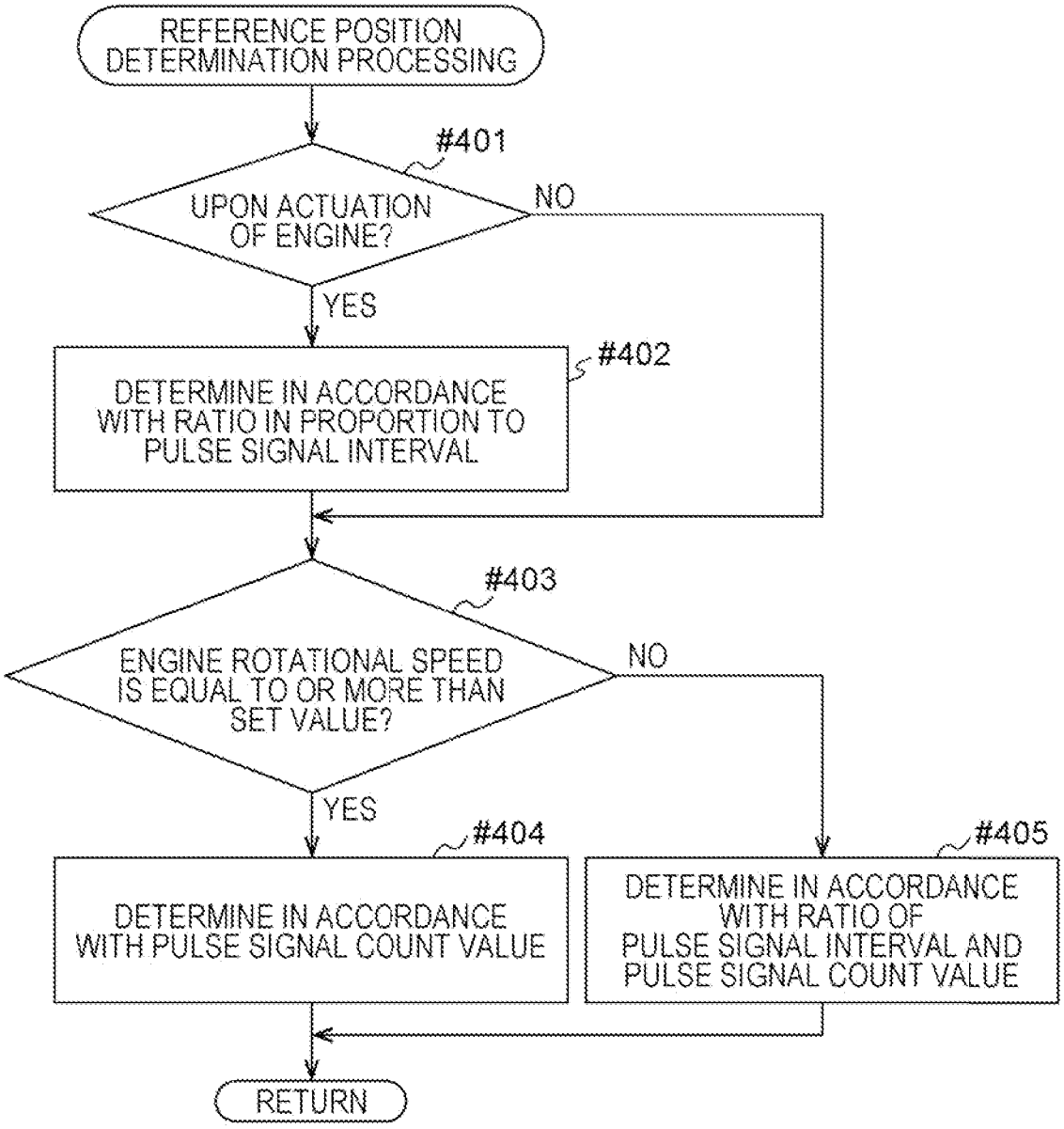
FIG. 9 is a flowchart of reference position determination processing.

Upon actuation of the engine E (Yes in step #401) like cranking start as depicted in a flowchart of FIG. 9, the reference position 16*n* is determined in accordance with a ratio of an interval of pulse signals serving as the crank angle signals of the crank angle sensor 16 (step #402). Control is executed to determine inapplicability of the reference position 16*n* when the pulse signals are consecutively provided at a set ratio even though the crank shaft 1 has slightly varied rotational speed upon actuation of the engine E, and to determine the rotation angle of the crank shaft 1 as the reference position 16*n* at extended timing when the pulse signals are consecutively provided at extended ratio than the set ratio.

If the rotational speed of the engine E is equal to or more than set speed (Yes in step #403) while the engine E is not actuated (No in step #401), the reference position 16*n* is determined in accordance with the count value of the pulse signals of the crank angle sensor 16 (step #404). The reference position 16*n* is detected each time a set number of pulse signals are counted along with rotation of the crank shaft 1 while the engine E is in operation. Accordingly, even when the engine E is changed in rotational speed, pulse signals are counted for control to determine the reference position 16*n*.

If the rotational speed of the engine E is not equal to or more than the set speed (No in step #403), the reference position 16*n* is determined in accordance with control to determine the reference position 16*n* in accordance with the ratio of the interval of the pulse signals of the crank angle sensor 16 as in step #402 and control to determine the reference position 16*n* in accordance with the count value of the pulse signals as in step #404 (step #405). This determination may be made in a control mode with establishment of an AND condition.

Functional Effect of Embodiment

In a case where a single divided region can be specified by acquiring the crank angle signal at the first detection timing of initial detection of the cam angle signal by the cam angle sensor 17 and referring to the storage 45 in accordance with the crank angle signal acquired at the first detection timing in the determination processing (step #104 and step #105) after the engine E is actuated, the actual phase can be acquired early in accordance with the crank angle signal corresponding to the boundary of the specified divided region and the reference crank angle signal. Such early acquisition of the actual phase enables an early shift to a phase appropriate for actuation as well as smooth actuation of the engine E.

Even in a contrast case where any single divided region cannot be specified, the divided region can be specified and the actual phase can be acquired only with approximately quarter rotation of the inlet cam shaft 7. Upon actuation of the engine E, the relative rotation phase of the valve open-close timing control device A is shifted to a phase appropriate for actuation and the engine E is smoothly actuated.

In this manner, the divided region is determined in accordance with the detection signal of the cam angle sensor 17 and the detection signal of the crank angle sensor 16, and the edge is determined to acquire the actual phase. This processing is more portable than acquisition of the actual phase through determination of a waveform pattern of the detection target projection 17T by the cam angle sensor 17, with no positional restriction of attachment of the cam angle sensor 17 even in a case of provision in a different type of vehicle.

Other Embodiments

This disclosure may optionally include any of the following configurations in addition to the embodiment described above (those functionally similar to corresponding parts according to the above embodiment will be denoted by common numbers or reference signs).

(a) In the actual phase acquisition processing according to the above embodiment, the first divided region C1 is enlarged relatively to the second divided region C2 depicted in FIG. 4, to increase probability of specification in step #105 in the flowchart of FIG. 6. Such increase in probability of specification leads to faster acquisition of the actual phase and earlier actuation of the engine E.

(b) The cam angle sensor can include six detection target projections 17T correspondingly to a six-cylinder engine. Provision of the six detection target projections 17T in the cam angle sensor 17 will achieve a cylinder determination function with the six-cylinder engine.

This disclosure provides a valve open-close timing control device structurally characterized by including a driving rotator rotatable about a rotation axis and configured to rotate simultaneously with a crank shaft of an internal combustion engine, a driven rotator rotatable about the rotation axis and configured to rotate integrally with a cam shaft for valve opening-closing in the internal combustion engine, a phase adjusting mechanism configured to set a relative rotation phase between the driving rotator and the driven rotator with use of drive power of an electric motor, and a sensor unit configured to detect the relative rotation phase, the sensor unit including a crank angle sensor configured to detect a crank angle signal as angle information along with rotation of the crank shaft, and a reference crank angle signal as angle information from a reference position preliminarily set, along with rotation of the crank shaft, and a cam angle sensor configured to detect a cam angle signal each time the cam angle sensor reaches a boundary of each of divided regions obtained by preliminarily dividing a single-rotation region of the cam shaft at unequal angles; a storage configured to store the plurality of divided regions consecutively provided, as a plurality of divided length information pieces corresponding to divided lengths of the divided regions, and an actual phase acquisition unit configured to start acquisition of the crank angle signal and the cam angle signal along with start of actuation control of actuating the internal combustion engine, specify one of the divided regions by referring to the divided length information pieces stored in the storage in accordance with the crank angle signal at timing set in accordance with the cam angle signal, and acquire the relative rotation phase as an actual phase in accordance with the crank angle signal corresponding to the boundary of the divided region thus specified and the reference crank angle signal.

According to the structural characteristics, acquisition of the crank angle signal by the crank angle sensor and acquisition of the cam angle signal by the cam angle sensor start along with start of actuation control of actuating the internal combustion engine, one of the divided regions is specified by referring to the divided length information stored in the storage in accordance with the crank angle signal at the timing set in accordance with the cam angle signal, and the actual phase acquisition unit acquires the actual phase in accordance with the crank angle signal corresponding to the boundary of the divided region thus specified and the reference crank angle signal. The valve open-close timing control device is accordingly set to have the relative rotation phase appropriate for actuation of the internal combustion engine in accordance with the actual phase thus acquired.

In comparison to a processing mode of acquiring the cam angle signal of the cam angle sensor after the internal combustion engine is actuated, subsequently acquiring the crank angle signals until acquisition of the signals as references of the crank angle signals, and acquiring the actual phase in accordance with the value of the crank angle signals, time can be shortened until acquisition of the actual phase and the internal combustion engine can be actuated earlier.

The valve open-close timing control device is thus configured to shortly acquire the relative rotation phase upon actuation of the internal combustion engine to enable smooth actuation of the internal combustion engine.

As an optional configuration in addition to the above configuration, the actual phase acquisition unit refers to the divided length information pieces in the storage in accordance with the crank angle signal at first detection timing of initial detection of the cam angle signal after the actuation control starts, executes determination processing of determining whether or not the divided region corresponding to the first detection timing is specifiable, and acquires the actual phase when the divided region is specifiable, in accordance with the crank angle signal corresponding to the boundary of the divided region thus specified and the reference crank angle signal, when the divided region is not specifiable in the determination processing, the actual phase acquisition unit refers to the divided length information pieces in the storage in accordance with a difference between the crank angle signal at second timing of subsequent detection of the cam angle signal by the cam angle sensor and the crank angle signal at the first detection timing, specifies the crank angle signal for the boundary of the divided region corresponding to the crank angle signal for the difference, and acquires the actual phase in accordance with the crank angle signal thus specified and the reference crank angle signal.

In a case where there are four divided regions, four cam angle signals are detected when the cam shaft rotates once and there are four types of crank angle signals upon detection of the four cam angle signals. In the case where the four divided regions are provided, the storage stores four divided length information pieces corresponding to the four crank angle signals. In a case where a single divided region can be specified by acquiring the crank angle signal at the first detection timing of initial detection of the cam angle signal by the cam angle sensor and referring to the storage in accordance with the crank angle signal acquired at the first detection timing in the determination processing after the internal combustion engine is actuated, the actual phase can be acquired in accordance with the crank angle signal corresponding to the boundary of the specified divided region and the reference crank angle signal, without need for acquisition of subsequent cam angle signals.

One of the four divided regions can be specified under a considerable condition where the crank angle signal detected at the first detection timing is smaller than the largest one of the four divided length information pieces store in the storage and is larger than the remaining three divided length information pieces. In a contrast case where no divided region can be specified through the determination processing, one of the divided length information pieces is specified by referring to the storage in accordance with a difference between the crank angle signal at the second timing for subsequent detection of the cam angle signal and the crank angle signal at the first detection timing, and the actual phase can be acquired in accordance with the crank angle signal corresponding to the boundary of the divided region thus specified and the reference crank angle signal.

In this manner, the actual phase can be acquired early when the single crank angle signal can be specified with the initial cam angle signal, and the actual phase can be reliably acquired after acquisition of the subsequent cam angle signal even when no divided region can be specified at the first detection timing.

As an optional configuration in addition to the above configuration, the cam angle sensor includes a rotary member configured to rotate integrally with the cam shaft, and a detector supported at a fixed system to detect upstream or downstream ends in a rotation direction of a plurality of detection target projections projecting radially outward from the rotary member and having different circumferential lengths.

According to this configuration, when the cam shaft rotates, the detector can detect the end of the detection target projection of the rotary member.

As an optional configuration in addition to the above configuration, the crank angle sensor includes a gear shape member configured to rotate integrally with the crank shaft and having an outer circumference provided with a plurality of detection target teeth, and a detection mechanism supported at a fixed system to detect the detection target teeth during rotation of the crank shaft, and the reference position is set by removing part of the plurality of detection target teeth.

According to this configuration, the detection mechanism detects the plurality of detection target teeth at the gear shape member rotating integrally with the crank shaft, so that the detection mechanism outputs signals that can serve as crank angle signals. The detection target teeth of the gear shape member are partially removed to provide lacking among signals detected by the detection mechanism, and the reference crank angle signal can be detected with timing of lacking among the signals as a reference position.

This disclosure is applicable to a valve open-close timing control device configured to control valve open-close timing of a cam shaft in an internal combustion engine.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve open-close timing control device comprising:

a driving rotator which rotates about a rotation axis, the driving rotator configured to rotate synchronously with a crank shaft of an internal combustion engine;

a driven rotator which rotates about the rotation axis, the driven rotator configured to rotate integrally with a cam shaft of the internal combustion engine;

a phase adjusting mechanism configured to set a relative rotation phase between the driving rotator and the driven rotator, the phase adjusting mechanism driven via an electric motor;

a sensor unit configured to detect the relative rotation phase, the sensor unit including:

a crank angle sensor configured to detect a crank angle signal as the crank shaft rotates, the crank angle signal corresponding to a current angular offset from a predetermined reference position on the crank shaft, and a cam angle sensor configured to detect a cam angle signal as the cam shaft rotates, wherein a circumference of the cam shaft is divided into a plurality of regions such that each region has a unique circumferential length, and a respective cam angle signal is detected when a boundary of each region reaches the cam angle sensor; and an engine control unit (ECU) configured to:

store a plurality of length information pieces in memory, each length information piece respectively corresponding to the circumferential length of each region, initiate acquisition of the crank angle signal and the cam angle signal when the internal combustion engine is started, identify which region of the plurality of regions is being detected based on the crank angle signal and the corresponding length information piece when the cam angle signal is detected, acquire an actual relative rotation phase based on the crank angle signal and the cam angle signal of the identified region, and control the electric motor so as to set the relative rotation phase to a target phase based on the determined actual relative rotation phase, wherein when the internal combustion engine is started, the actual relative rotation phase is early acquired when the circumferential length of a current region of the plurality of regions is identified at a time that a first cam angle signal is detected, and wherein when the circumferential length of the current region cannot be identified at the time that the first cam angle signal is detected, a subsequent region of the plurality of regions is identified based on the crank angle signal and the corresponding length information piece when a second cam angle signal is detected.

2. The valve open-close timing control device according to claim 1, wherein:

the cam angle sensor includes a rotary member configured to rotate integrally with the cam shaft, the rotary member including a plurality of radially outward extending detection target projections, and each detection target projection defines a respective region of the plurality of regions such that the respective cam angle signal is detected when a detector supported at a fixed position detects an upstream or downstream end in a rotation direction of each detection target projection.

3. The valve open-close timing control device according to claim 1, wherein:

the crank angle sensor includes a gear shape member configured to rotate integrally with the crank shaft and having an outer circumference provided with a plurality of detection target teeth, a detection mechanism is supported at a fixed position so as to detect the detection target teeth during rotation of the crank shaft, and the reference position is set by removing part of the plurality of detection target teeth.

4. The valve open-close timing control device according to claim 2, wherein:

the crank angle sensor includes a gear shape member configured to rotate integrally with the crank shaft and having an outer circumference provided with a plurality of detection target teeth, a detection mechanism is supported at a fixed position so as to detect the detection target teeth during rotation of the crank shaft, and the reference position is set by removing part of the plurality of detection target teeth.

* * * * *